United States Patent [19]

Jacobs

[11] 4,061,000

[45] Dec. 6, 1977

[54] BELT DRIVE ARRANGEMENT FOR AGITATOR WASHER MECHANISM

[75] Inventor: James W. Jacobs, Dayton, Ohio

[73] Assignee: General Motors Corporation, Detroit, Mich.

[21] Appl. No.: 697,942

[22] Filed: June 21, 1976

[51] Int. Cl.[2] ..... D06F 13/02

[52] U.S. Cl. ..... 68/23.7; 192/48.91; 192/51

[58] Field of Search ..... 68/23.7, 23.6, 133; 192/48.91, 51

[56] References Cited

U.S. PATENT DOCUMENTS

| | | | |
|---|---|---|---|
| 2,414,515 | 1/1947 | Field | 10/136 |
| 2,441,926 | 5/1948 | Zahn et al. | 68/23.6 |
| 2,509,939 | 5/1950 | Poland | 68/140 X |
| 2,660,068 | 11/1953 | Emrick | 74/220 |
| 2,809,533 | 10/1957 | Emrick | 192/51 X |
| 3,062,346 | 11/1962 | Sharpe | 192/48.91 X |
| 3,165,938 | 1/1965 | Hayes | 74/220 |
| 3,576,138 | 4/1971 | Wildhagen | 74/220 |
| 3,691,860 | 9/1972 | Danuser | 74/242.1 R |

*Primary Examiner*—Philip R. Coe
*Attorney, Agent, or Firm*—Edward P. Barthel

[57] ABSTRACT

A domestic clothes washer drive mechanism for oscillating an agitator in a nested pair of tubs wherein the inner tub is rotatable and the outer tub is generally fixed against rotation and adapted to contain water. First and second concentrically arranged driven pulleys are rotatably carried in fixed respective planes with respect to the agitator and spin tub with concentric agitate and spin drive shafts related therewith. Drive belt means circle the driven pulleys to rotate same in opposite directions while clutch means are provided between the driven pulleys so as to be selectively operable to effect a driving relationship alternately between a drive motor and the driven pulleys.

5 Claims, 11 Drawing Figures

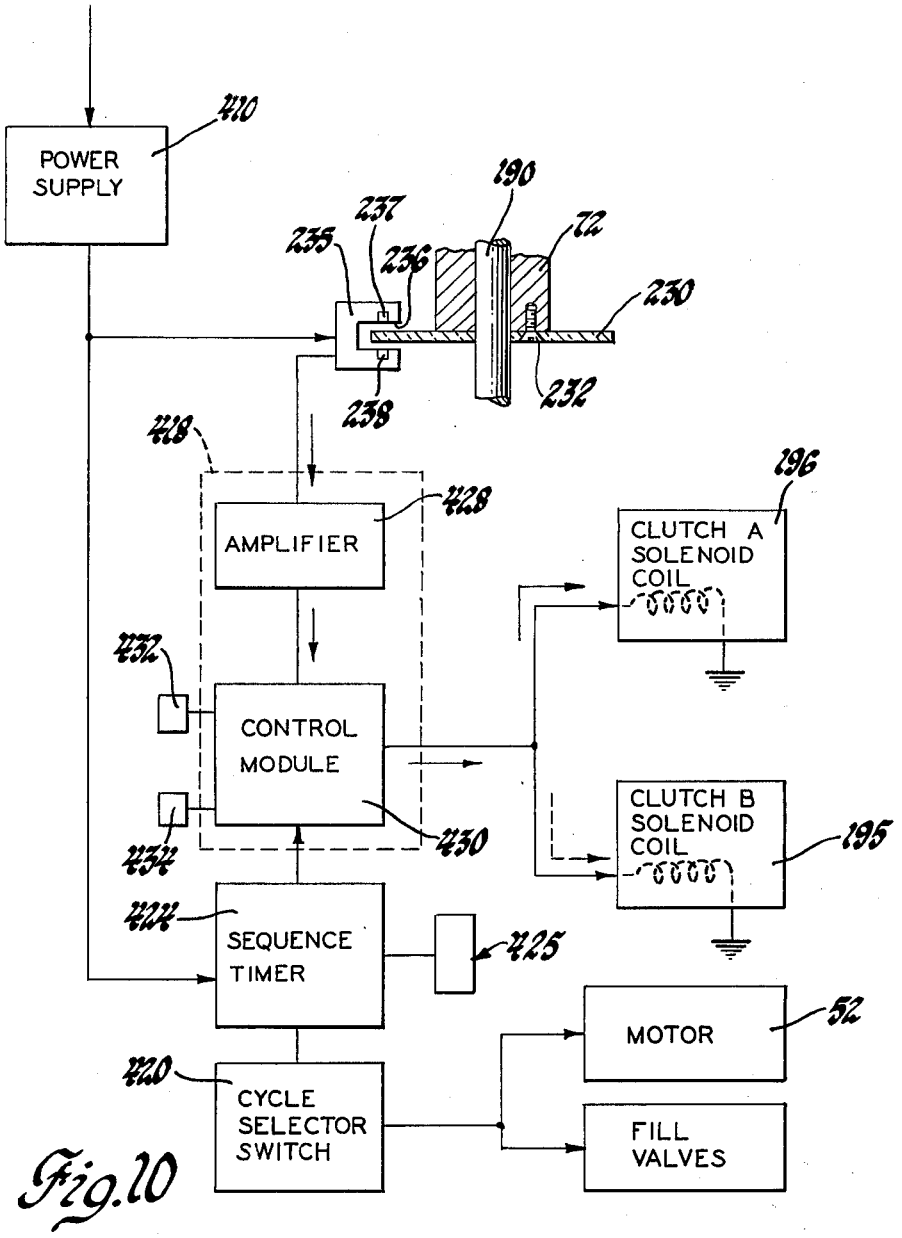

Fig. 10

| FUNCTION | MOTOR SPEED | MOTOR ROTATION | FUNCTION SPEED | DRIVEN PULLY | CLUTCH ENERGIZED | CLUTCH INPUT |
|---|---|---|---|---|---|---|
| FILL | — | — | — | — | — | — |
| AGITATE-LO | 1750 RPM | C. W. | 55 S/M | 650 RPM | A-B-A-B | FEEDBACK REGULATED |
| AGITATE-HI | 1750 RPM | C. W. | 80 S/M | 650 RPM | A-B-A-B | FEEDBACK REGULATED |
| SPIN DELAY (PUMP OUT) | 1750 RPM | C.C.W. | 1750 RPM (PUMP) | 650 RPM | — | — |
| SPIN-LO | 1750 RPM | C.C.W. | 430 RPM | 650 RPM | A | FEEDBACK REGULATED |
| SPIN-HI | 1750 RPM | C.C.W. | 650 RPM | 650 RPM | A | MAX. FORCE REGULATED |
| BRAKE | — | C.C.W. (PULSED) | — | — | B | FEEDBACK REGULATED |

Fig. 11

BELT DRIVE ARRANGEMENT FOR AGITATOR WASHER MECHANISM

This invention relates to a domestic appliance and, more particularly, to an improved agitating and spinning drive mechanism for a clothes washer.

In prior clothes washing art, wherein drive mechanisms have been provided for performing and controlling the agitation and spin operation in laundry machines, it has been the usual practice to convert the rotary motion of a driving source to an oscillating drive for an agitator by means of a suitable gearing arrangement which is not only expensive to manufacture but requires a closed gear housing with lubricating oil contained therein, commonly referred to as a wet running system. This invention permits the use of an agitation and spin drive mechanism in a laundry machine by means of the unique pulley and clutch arrangement which substantially reduces manufacturing cost while providing a dry running system to the extent that it eliminates the requirement of gear lubrication.

Accordingly, it is an object of this invention to provide an improved pulley and belt drive laundry machine drive mechanism of the dry running type for achieving the agitation and spin drying operation in the laundry machine.

It is another object of this invention to provide a clothes washer oscillate and spin drive mechanism for use with nested outer and inner tubs of a domestic clothes washer having concentrically arranged inner agitate and outer spin shaft assemblies which is simpler and less costly to manufacture and service. A reversible electric motor has a double-ended drive shaft operably connected to first and second concentrically arranged driven pulleys rotatably carried in fixed respective planes with respect to the agitator and spin tub such that drive belt means encircle said driven pulleys and the opposite ends of the motor drive shaft. Clutch means between the driven pulleys and relatively rotatable limited with respect to the agitator shaft assembly provide for selective engagement with the driven pulleys. Actuating means are selectively operable to move the clutch means into alternate engagement with the upper and lower driven pulleys such that the clutch means effects an alternate driving relationship between the double-ended drive shaft and the driven pulleys to rotate the driven pulleys in opposite directions. Thus, when the clutch is actuated in a continuously repetitive pulsating manner it effects back and forth oscillations of the agitator in the spin tub.

A still further object of the present invention is to provide an improved oscillate and spin drive mechanism for use with nested inner and outer tubs of a domestic clothes washer for selectively agitating and centrifugally extracting washing fluid through direction responsive means for controlling engagement of a friction clutch and wherein agitator shaft means have an upper portion extending through openings in both the outer and inner tubs and adapted for drivingly connecting an agitator to oscillate same in a fixed plane when the agitator shaft is oscillating. A spin shaft assembly extends through an opening in the outer tub and is adapted for driving concentric encircling arrangement with the agitator shaft and extends through the opening in the outer tub so as to be adapted for drivingly connecting the inner spin tub. Coupling means are provided for selectively drivingly interconnecting a spin shaft assembly with the agitator shaft assembly for rotation therewith to rotate the inner spin tub in either direction when depending upon the direction of rotation of the agitator shaft. Upper and lower concentrically arranged driven pulleys are provided to be rotably carried in fixed respective planes with respect to the agitate and spin shaft assemblies and whereby the friction clutch means is located between the driven pulleys and relatively rotatably limited with respect to the agitator shaft assembly but axially movable with respect to the driven pulleys for selective slippage engagement with the driven pulleys and wherein actuating means are selectively operable to move the clutch into slippage engagement alternately with the upper and lower driven pulleys.

In an alternative form of the invention, it is an object to provide a novel clutch operated agitator washer mechanism having a two-belt drive mechanism. First and second concentrically arranged driven pulleys are rotatably carried in fixed respective planes with respect to the agitator in the spin tub such that a single continuous first drive belt circles the driven pulleys to rotate them in opposite directions. A second speed reducer belt is provided which is operative with the drive shaft and an agitate speed reducer pulley on an intermediate stub shaft with the stub shaft having an agitate one-way clutch and pulley. Clutch means selectively operable to positively drive in alternating fashion the driven pulleys with the agitate speed reducer unit and the belts being effective to oscillate an agitator via the driven pulleys at a predetermined stroke while reversal of the motor causes free running of the agitate clutch and rotation of the spin tub.

Further objects and advantages of the present invention will be apparent from the following description, reference being had to the accompanying drawings wherein preferred embodiments of the present invention are clearly shown.

In the Drawings:

FIG. 10 is a block diagram of an electrical control arrangement for the present invention; and FIG. 11 is a functional chart setting forth the various modes of operation of the form of the invention of FIGS. 1-5.

Figure 1:
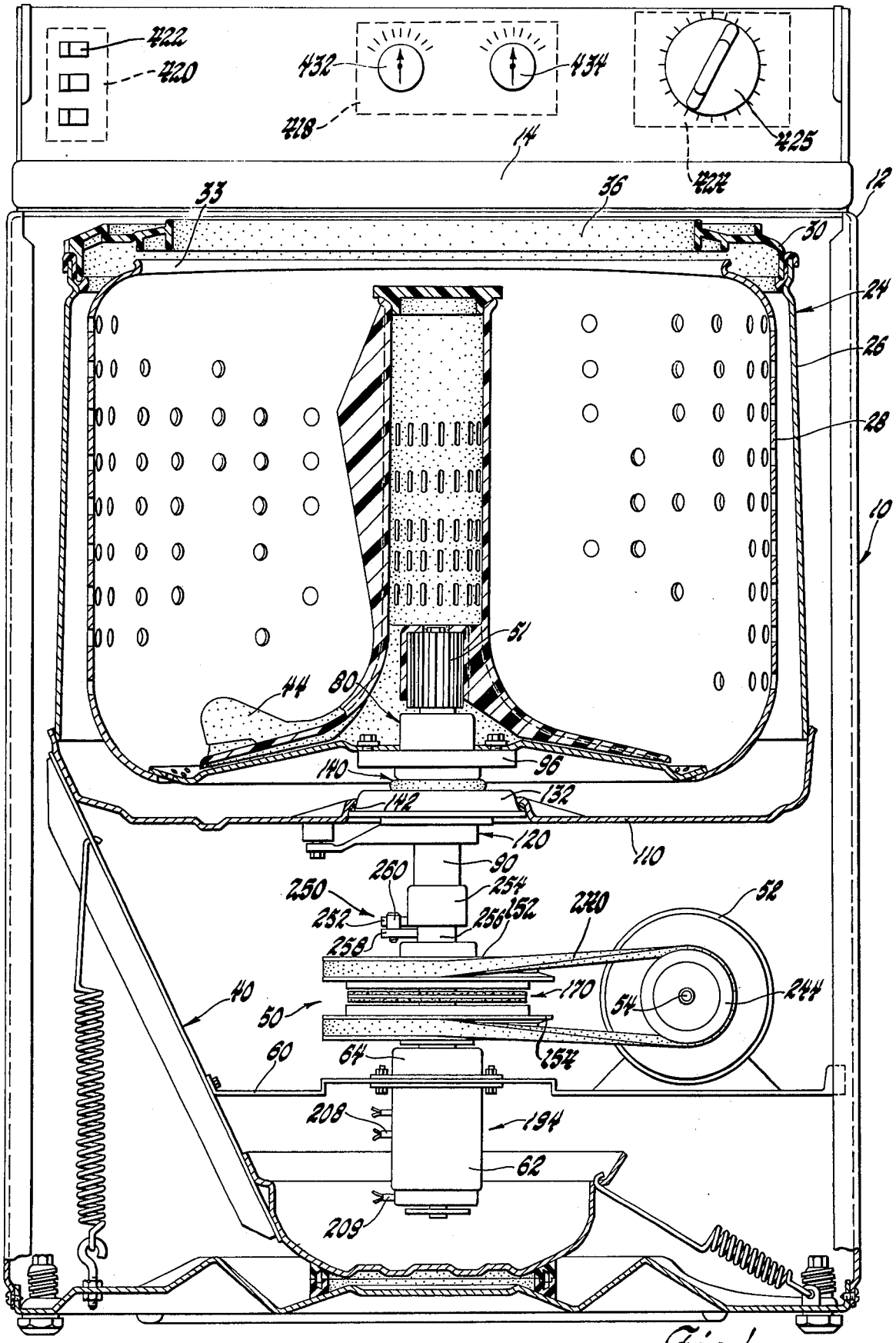
FIG. 1 is a side sectional view of a clothes washing machine, partly in elevation, with parts broken away to show one form of the drive mechanism of the present invention.

As the environment for this invention and with reference to FIG. 1, a domestic clothes washer is shown generally at 10. The washer includes a box-like sheet metal casing 12 having a top wall 14. The top wall has an access opening (not shown) through which clothes are loaded and unloaded.

The casing 12 is shown to enclose a nested tub assembly 24. The assembly includes an open top imperforate wall water container or outer tub 26 and a perforate wall spin basket or inner tub 28. Perforations are coextensive with the cylindrical side wall of the spin basket. An annular plastic subtop 30 is sealingly clamped to the open top of the water container 26. The subtop circumscribes the open top of the water container and extends over a rim 33 forming a top opening of the spin basket 28 to define an access collar 36 between the access opening of the cabinet and the top opening of the spin basket.

Water container 26, and thus the tub assembly 24, is mounted on a suspension system shown generally at 40 and more fully taught in U.S. Pat. No. 3,493,118 granted Feb. 3, 1970. The tub assembly includes an agitator 44 which with the spin basket 28 is connected to a drive mechanism, shown generally at 50, by means of a splined agitator drive 51. In the first embodiment of the invention drive mechanism 50 is operated by a prime mover, such as an electric motor shown in the disclosed form as a four-pole, reversible motor 52 having a double-ended armature shaft 54 which may be selectively operated to oscillate the agitator 44 for washing clothes in the tub assembly and may be operated in another manner wherein the spin basket 28 is rotated with respect to the washer container 26 for centrifuging washing fluid from the clothes in the spin basket.

With reference now to FIGS. 2–5, applicant's first embodiment of his drive mechanism, generally indicated at 50, is shown having a mechanism support means which in the disclosed form is an annular support plate 60 extending inwardly to a lower suspension housing or tube 62 and a lower bearing housing 64, the annular flanges of which are suitably secured to plate 60 as by through bolts one being shown at 66. The plate 60 has a central aperture 67 for the reception of the lower end of agitator shaft means, generally indicated at 70, having a lower portion 72 connected by pin 74 to upper agitator shaft portion 76 with lower bearing 78 rotatably supporting shaft portion 72 by means of lower bearing housing 64.

The oscillatable agitate drive shaft means has its upper portion 76 concentrically encircled by spin drive shaft means, in the form of an assembly generally indicated at 80, including a spin tub support hub member 82 having a depending hub sleeve 84 fixedly secured to inner spin tube 86 as by key 88. The tub support hub 82 is held on the upper end of spin tube 86 by a nut 89 and both become part of the spin drive shaft means 80. The spin shaft assembly also includes a lower spin sleeve 90 fixed to the lower end of the spin tube 86 for rotation therewith. Thus, it will be seen that the spin tube 86 is rotatably journaled concentrically about the agitator shaft upper portion 76 by bearing means in the form of upper and lower sleeve bearings 92 and 94.

The spin shaft assembly transmits its rotation to the spin basket 28 by extending through a central opening 98 in the spin basket wherein the basket is adapted for connection with the drive mechanism 50 by being carried by means of circling flange 96 forming a part of the hub member 82 with the flange 96 being attached to the spin basket 28 by fasteners such as bolts 99.

The outer tub 26 includes a bottom wall or bulkhead 110 which together with the support plate 60 operate to support the drive mechanism 50 therebetween. A centrally drawn cup or boss 112 projects upwardly from the bulkhead 110 and has an annular flange 114 on the inside thereof defining an outer tub opening 116 which is in axial alignment with opening 98 in the spin basket 28. Supported on the outer tub or receptacle 26 is a spin tub supporting casting 120 including a central bearing cup 122 and radiating spider arms 124, with the arms being fastened to the outer tub 26 by bolts 126 threaded in nuts 127 positioned in bulkhead lugs 128 while an antifriction bearing 130 supports and journals an intermediate portion of the spin tube 86. A cast seal retainer collar 132 has depending bosses 134 supported on arms 124 by lugs 136 being received in aligned arm holes while an inner conventional water or fluid seal assembly 140 is provided between relatively rotating spin shaft assembly 80 and the collar 132 to prevent water leaking into the drive mechanism 50. One such seal arrangement is disclosed in U.S. Pat. No. 3,793,854 assigned to the same assignee as the present application. An outer O-ring tub seal 142 is provided between the boss 112 and the annular cast flange 144 of the collar 132.

The drive mechanism 50 includes a pair of upper and lower concentrically arranged vertically spaced driven pulleys 152 and 154 respectively, supported on the lower portion 72 of the agitate shaft means such that the driven pulleys are freely rotatable thereon. In the embodiment of FIGS. 1–5 the upper 152 and lower 154 pulleys are shown as mirror images with the upper pulley 152 including integral bearing hub 156 such that the pulley 152 is rotatably mounted relative to agitate shaft 72 on a bearing 162, the inner race of which is secured to shaft 72. In a similar manner lower pulley 154 is rotatably mounted relative to agitate shaft 72 on a bearing 164 in integral bearing hub 166. Clutch means 170, in the form of upper clutch A and lower clutch B, is shown positioned between the driven pulleys with friction material 174 being bonded to both the top and bottom of clutch plate 172 to facilitate a driving relationship between the clutches A and B and their opposed clutch faces 176 and 178 formed integral with the opposed faces of upper and lower pulleys 152 and 154, respectively. It will be noted that the pulleys 152 and 154 are rotatably carried on the agitate shaft in fixed horizontal respective planes with respect to the agitator 44 and the spin tub 28.

The clutch means 170 is rotatively fixed to the agitate shaft lower portion 72 for drivingly rotating the agitator shaft assembly 70 relative to either of the driven pulleys 152, 154. In the disclosed embodiment of FIGS. 1–5 the clutch plate 172 is secured to the circular flange 182 of a clutch hub 184 with the hub having holes for the reception of a clutch pin 186 extending through aligned slot 188 in the agitate shaft lower portion 72 to allow for limited axial up and down or vertical travel of the clutch plate 172 and hub 184.

The clutch pin 186 is fixed to an actuating rod 190 slidable in the central axial bore 192 of the agitator shaft lower portion 72. In the embodiment of FIGS. 1–5 vertical sliding movement of the clutch rod 190 is achieved by an electrically operated solenoid means such as a push/pull solenoid assembly, indicated generally at 194, available commercially from Ledex, Inc. of Dayton, Ohio. The solenoid assembly 194 for reciprocating the clutch plate 172 is disposed below the lower end of the agitator shaft portion 72 by means of the lower solenoid suspension tube 62. The solenoid assembly 194 is composed of upper and lower solenoid windings or coils 195 and 196 respectively, (shown in section), having soft iron magnetizable stator poles 197, 198 providing suitable flux or air gaps indicated at G and G' for armatures 199 and 200, respectively, pressed on armature rod 203.

Solenoid assembly 194 is suitably secured to housing 62 as by a resin cement and has its windings 195 and 196 encapsulated in hollow cylinder or stator cups 201 and 202. The armature rod 203 is connected to the bottom end of rod 190 by means of rotatable thrust bearing and coupling assembly 204. The rod 190 reciprocates vertically up or down from its first or clutch intermediate disengaged position in response to the alternate energization of coils 195 and 196 respectively. Consequently, the armature rod 203 including enlarged soft iron head armatures 199, 200 and coupled actuator rod 190 are moved up or down by magnetic attraction to complete the flux path through either gap G or G' depending upon which coil is energized. Electrical leads 208 and 209 are provided so that the coils 195 and 196 may be electrically connected to a suitable power source (not shown). Thus, when either of the solenoid coils 195 or 196 is energized the armature rod 203 reciprocates vertically in response thereto to cause a rise or fall of the rod 190 and of clutch plate 172.

Figure 2:
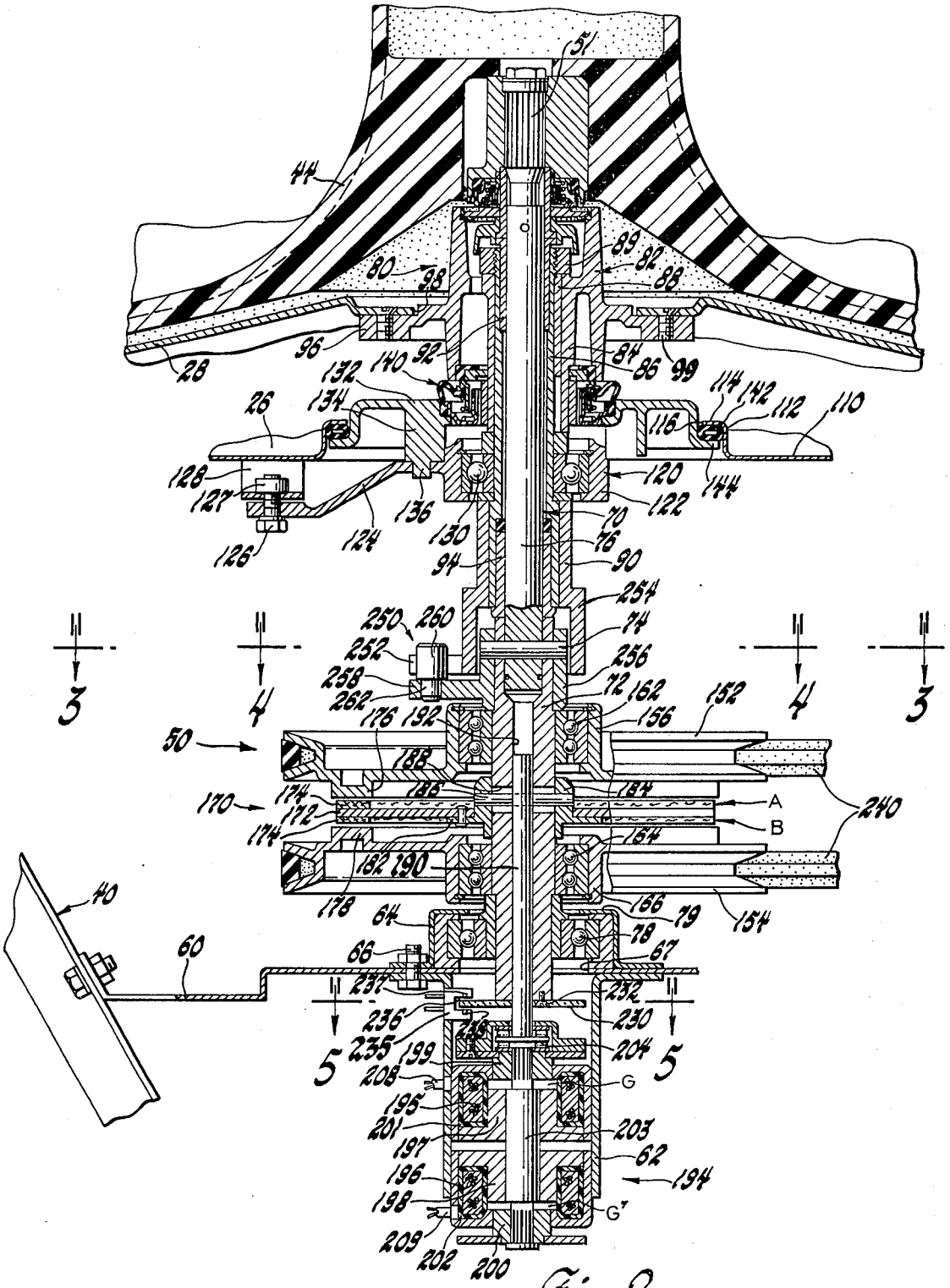
FIG. 2 is an enlarged fragmentary side sectional view, partly in elevation, of the agitator drive mechanism of FIG. 1.
Figure 5:
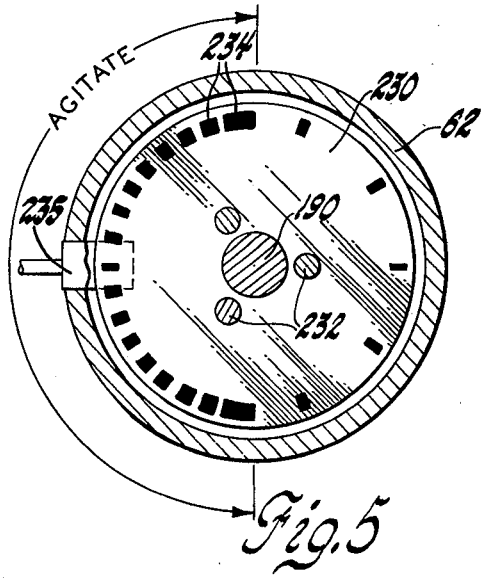
FIG. 5 is a horizontal cross-sectional view taken along the line 5—5 of FIG. 2.

Sensing means are provided to sense the angular position or stroke angle of the agitator shaft 70 to control the desired oscillating motion of the agitator 44. While in the disclosed form an optical-electronic sensing feedback system is set forth, such as disclosed in U.S. Pat. No. 3,746,988 — Ford et al, it will be understood that other control sensing means such as an electro-mechanical switching means, for example, could be used without departing from the scope of the invention. FIG. 2 shows a translucent encoder disc 230 secured to the bottom end of the agitate shaft such as by screws 232. As seen in FIG. 5 the encoder disc upper face has a plurality of radial dark or black segments 234. An opto-electronic source and sensor or detector block 235 is located in an aperture of the solenoid housing 62. The detector block 235 has a horizontal slot 236 positioned such that the outer periphery of the encoder disc 230 rotates therethrough. An infrared lamp or light emitting diode (LED) light source 237 is provided in the upper portion of the detector block which directs a light beam toward a photo-transistor light sensor 238. When the segments 234 do not interrupt the beam energy is transmitted to the sensor. From the sensor 238 a square wave voltage signal or pulse is produced at the same frequency as that at which the beam is being interrupted, is fed to a control module (FIG. 10) to be described. The photo-resistive semi-conductor sensor 235 reads segments 234 to sense the angular position of the agitator shaft 72 and thus the agitator 44 to control the voltage applied to coils 195, 196. In the disclosed form the optical sensing system causes oscillations of the agitator 44 at a speed of the order of 80 oscillations per minute and through an arc or stroke of about 180°.

Figure 3:
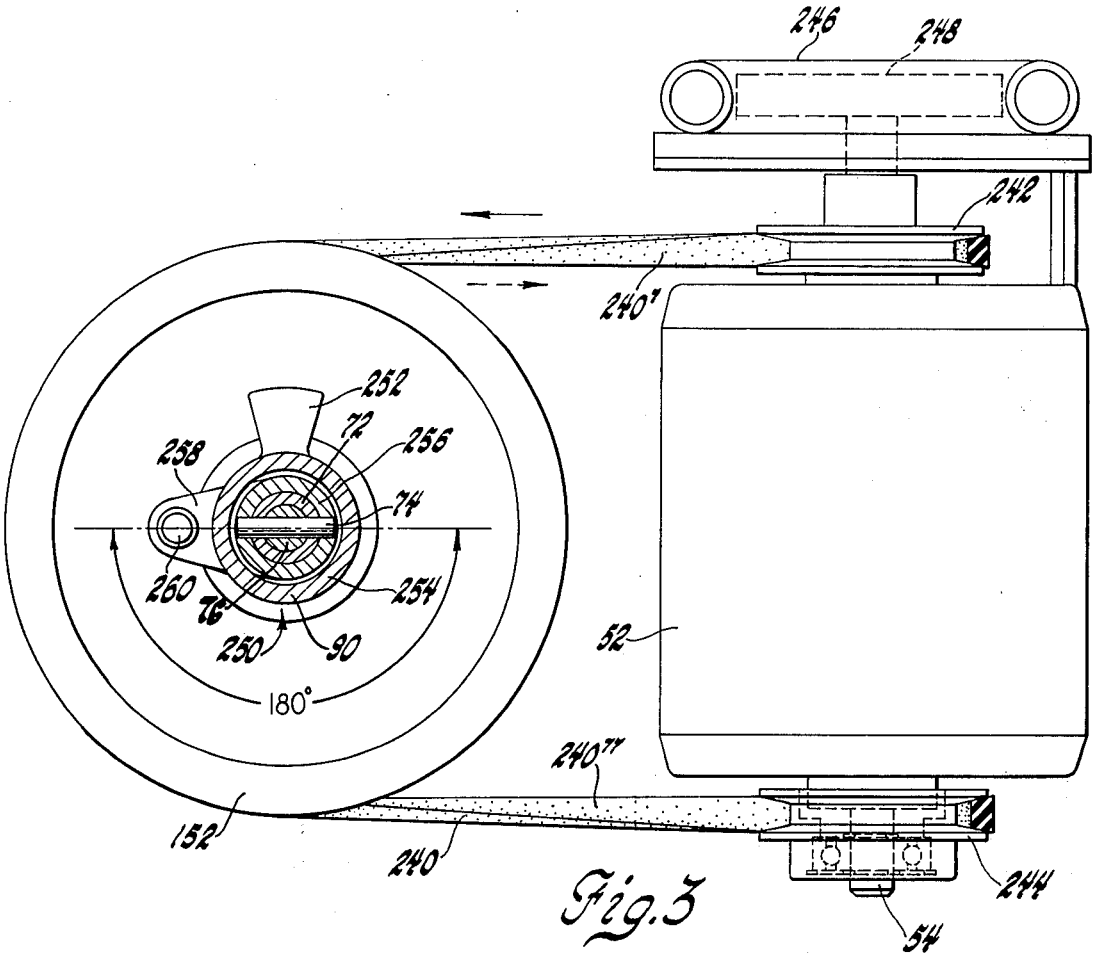
FIG. 3 is a cross-sectional view, with parts shown in elevation of the parts removed for the sake of clarity, taken substantially on the plane of line 3—3 of FIG. 2.

The driven pulleys 152 and 154 of the drive mechanism are operably connected to the drive shaft 54 of motor 52 by belt means which in the disclosed form is a single continuous V-drive belt 240. As seen in FIG. 3 the double-ended drive shaft 54 has a drive pulley 242 fixedly secured on one end thereof and an idler pulley 244 on its opposite end which is mounted so that it is freely rotatable on the shaft 54 with ball bearings (shown in dotted lines) located therebetween. In the preferred form the drive pulley 242 and the idler pulley 244 are axially spaced on centers a distance approximately equal to the diameter of driven pulleys 152 and 154 to provide substantially parallel runs of the belt linear passes 240' and 240''. The double-ended drive shaft 54 has a pump housing 246 on its one end which encloses an impeller 248 attached to the shaft 54. It will be noted in the disclosed form that the drive shaft 54 is placed substantially perpendicular to the axial direction of the agitating 70 and spin 80 shaft assemblies.

Figure 4:
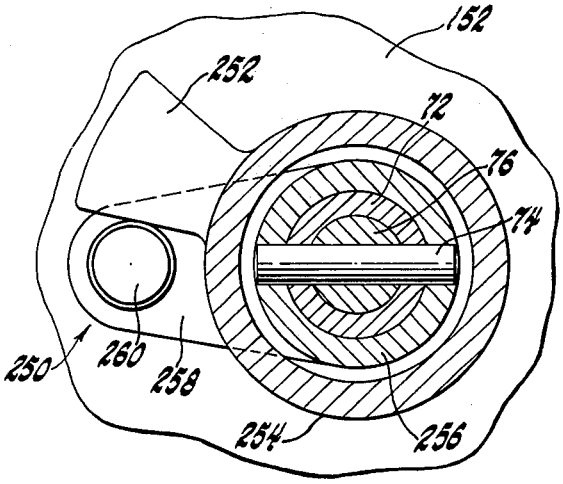
FIG. 4 is an enlarged sectional view taken on the line 4—4 of FIG. 2.

With reference to FIGS. 2 and 4, coupling means 250 are provided operative upon engagement to connect the concentric outer spin shaft assembly lower sleeve 90 and the inner agitate shaft portion 76 during a spin cycle of the spin basket 28 in a manner to be explained below. In the form shown the coupling means 250 includes a radial lug member 252 secured as by welding and integral with the flared or bell-shaped portion 254 of the lower sleeve 90. The bell 254 telescopes over the upper end of agitate shaft coupler hub 256 which has a radial ear 258 for supporting an axially disposed drive member 260 secured to ear 258 by pin portion 262. It will be noted that the transverse agitate shaft pin 74 extends through the hub 256 so that the hub 256 rotates in unison with the agitate shafts 72 and 76.

By virtue of the above-disclosed arrangement the drive belt 240 is operatively mounted in a single pass on the drive pulley 242, the upper driven pulley 152 in the fixed plate thereof, the idler pulley 244 and the lower driven pulley 154 in the fixed plane thereof such that upon the drive shaft being rotated in its normal or forward clockwise direction the drive belt 240 will cause the upper driven pulley 152 to be rotated in a clockwise manner while the lower driven pulley 154 will be driven simultaneously at the same speed in a counterclockwise direction. Upon the motor 52 being reversed the drive shaft 54 will rotate in a counterclockwise direction causing the drive belt to drive the upper pulley 152 in a counterclockwise direction while simultaneously driving the lower pulley 154 in a clockwise direction. Said another way, the driven pulleys will be simultaneously driven in opposite directions of rotation by rotation of the drive shaft in either direction.

The clutch means 170, located between the driven pulleys, is relatively rotatably limited with respect to the agitator shaft assembly 70 but axially movable with respect to the driven pulleys 152 and 154 for selective engagement therewith. In this way actuating means 194 which in the form disclosed is solenoid push/pull assembly 194, is selectively operable to move the clutch plate 172 into engagement alternately with the upper and lower driven pulleys. Thus, the clutch means is operative for drivingly rotating the agitator 44 relative to either of the driven pulleys 152 or 154 such that the clutch plate 172 is selectively operable to effect a slippage drive relationship first between the drive shaft 54 and one of the driven pulleys and then between the drive shaft 54 and the other of the driven pulleys when the drive shaft is operating through the drive belt 240 to rotate the driven pulleys in opposite directions.

The result is that, by virtue of the encoder disc 230, segments 234 being read or sensed by the detector block 235 to alternately energize solenoids 195 and 196 upon each 180° oscillation of the agitator 44, the clutch plate is moved up and down in a continuously repetitive pulsating manner to effect the back and forth oscillation of the agitator 44 in the spin tub 28.

The control system is also operative to continuously energize one of the solenoid coils to cause the actuator shaft to move the clutch plate into continuous locked drive engagement with one of the driven pulleys to effect a spin rotation of the spin tub 28. This occurs because the coupling means 250 is operative upon the agitate shaft being rotated in one direction to cause the agitate shaft drive member 260 to engage the spin shaft lug member 252 thereby connecting the agitate shaft assembly to the spin shaft assembly effecting rotation of the spin tub.

In the disclosed form of FIGS. 1–5 upon the lower solenoid coil 196 being continuously energized the rod 190 is moved upwardly causing the upper clutch pads 174 to engage the upper pulley 152 to provide clockwise rotation of the spin tub 28. It will be seen that in this mode the pump impeller 248 is driven in its clockwise direction to effect water pump-out of the outer tub 26.

Turning now to an alternate embodiment of the present invention in FIGS. 6–9 there is shown a single speed agitator oscillating and spin mechanism (approximately 180° stroke 80 oscillations/minute) which can be substituted for the variable speed oscillating and spin mechanism of FIGS. 1–5. Corresponding parts are indicated by the same reference numerals.

Figure 6:
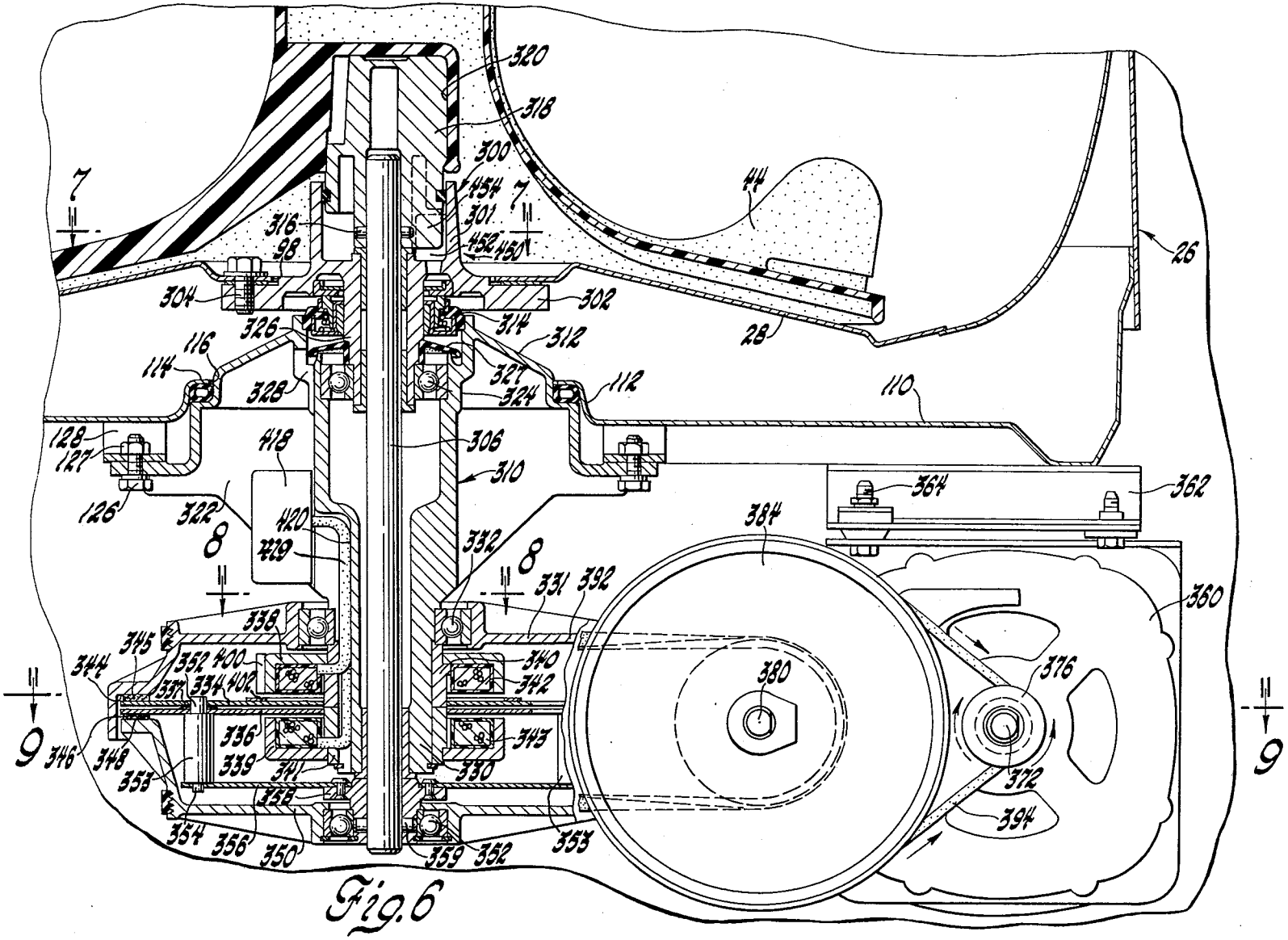
FIG. 6 is an enlarged fragmentary side sectional view, partly in elevation, of a modified agitator drive mechanism of the present invention.

As in the previously described construction of FIGS. 1–5, relative rotation between the outer tub 26 and inner spin basket 28 is permitted. As seen in FIG. 6, this is achieved by fastening the bottom wall of the spin basket 28 to spin shaft 300 by being fastened to its base 302 by means of bolts as at 304. The rotatable spin drive shaft 300 is concentric with inner agitate drive shaft 306. Both shafts 300, 306 extend from, and are enclosed by, a cast housing portion 310 of the mechanism support. Housing 310 includes an attached or integral frustoconical or skirt portion and seal support 312 with seal assembly 314 carried on a shouldered recess of the seal support 312 and forms a water tight static connection therewith. The extensions of the shafts 300 and 306 are adapted for connection, respectively with agitator 44 and spin basket 28. In this regard, agitator drive shaft 306 has attached on its upper end an secured thereto by pin 316 a splined agitator-driver 318 as a portion of the agitate drive shaft means. The driver interfits with a complementary socket or bottom opening 320 in the underside of agitator 44 and transmits the oscillations of the agitator shaft 306 to the agitator.

The outer tub bulkhead 110 has its centrally drawn cup or boss 112 provided with an annular flange 114 defining outer tube opening 116 which is in axial alignment with opening 98 in the spin basket 28. The housing 310 includes spider-like radiating arms 322 fastened to the outer tub 26 by bolts 126 while antifriction bearing 324 supports and journals depending tube portion 326 of the spin shaft 300. A rotating seal 327 is provided on the spin shaft portion 326 and acts as a slinger seal to intercept any water escaping the seal assembly 314 and directs or slings the water outwardly through a discharge passage or slot 328.

The housing 310 has its reduced lower portion 330 adapted to receive a driven upper pulley portion 331 of an electro-magnetic clutch, which is mounted on the portion 330 by means of a bearing structure 332 so that it can rotate relative to the portion 330. The clutch structure includes clutch armature means in the form of upper and lower clutch armature plates or discs 334 and 336 respectively, separated by spring means in the form of an annular spring wave washer 337 in sandwiched relation between the discs. The discs are rotatably located on the housing portion 330 for limited vertical movement between upper and lower electro-magnetic actuating clutch coil iron structures 338 and 339 suitably affixed to the housing portion by means of inner coil sleeves 340 and 341 enclosing copper wire coils 342 and 343. The upper disc 334 is mounted in juxtaposition to the annular clutching surface or face 344 of upper driven pulley 331.

Each of the armature discs 334 and 336 are provided with an annular strip of friction material or pads 345 and 346 respectively, with the wave spring washer 337 maintaining the pads in engagement with the clutching surfaces 344 of the upper pulley and 348 of a lower driven pulley 350. The lower pulley 350 is mounted on the lower end of the agitate drive shaft 306 by means of bearing structure 352 so that it can rotate relative to the agitate shaft with its clutching surface juxtaposed to the friction pad 346.

The clutch armature discs have aligned apertures for receiving upper end 352 of a plurality of driven pins 353 while the pins' reduced lower ends 354 are received in the outer end of an associated radiating torsion drive spring 356. Springs 356 extend radially from a hub 358 secured to the agitator shaft by means of a roll pin 359.

Figure 9:
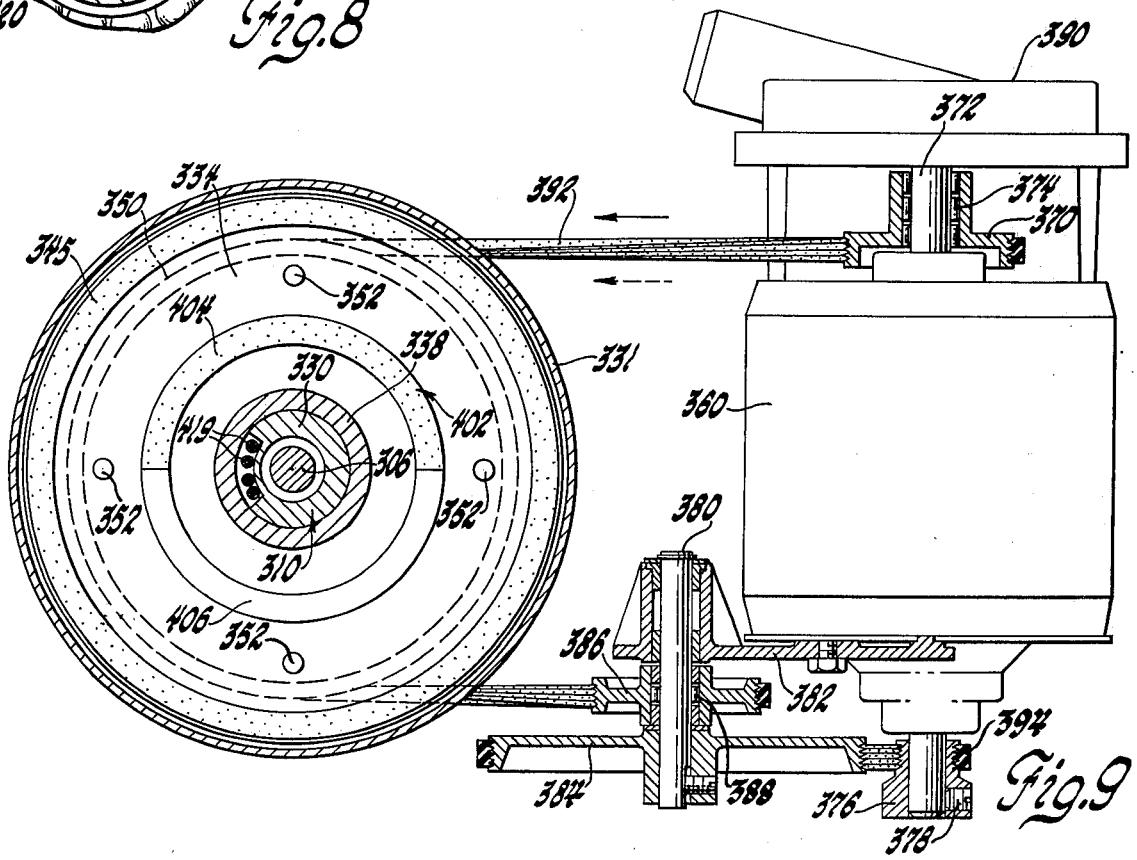
FIG. 9 is an enlarged sectional view, partly in elevation, taken substantially on the line 9—9 of FIG. 6.

As best seen in FIGS. 6 and 9, a reversible motor 360 is resiliently supported by an angular support member 362, fixed to the frame of the washer, by means of bolts 364. The motor has a spin drive pulley 370 secured to one end of its shaft 372 by an overrunning one-way clutch 374. A speed reducer pulley 376 is secured, as by set screw 378, to the opposite end of the shaft 372. A stub or jack shaft 380 is supported in parallel offset relation to motor shaft 372 on the motor housing by bracket 382. The stub shaft 380 supports an agitate speed reducer pulley 384 and a pulley 386 is also mounted on the stub shaft secured thereto by an overrunning one-way clutch 388.

The one end 372 of the motor drive shaft is drivingly associated with a water pump 390 which pumps water from the outer tub when the motor shaft is driven in a clockwise manner. Drive belt means are provided for encircling the driven pulleys 331 and 350 and opposite ends of the motor shaft 372. In the alternate form of the invention of FIGS. 6–9 the belt means include a first drive belt 392 which extends in a single pass over the spin one-way clutch pulley 370, the lower driven pulley 350, the agitate one-way clutch pulley 386, and the upper driven pulley 331. It will be noted that as the vertical axes of driven pulleys 331 and 350, coinciding with the axes of the concentric agitate shaft 306 and spin shaft 300, are at right angles to the horizontal axes of the stub shaft 380 the first drive belt 392 is twisted in its linear passes between the driven pulleys 331, 350 and the clutch pulleys 370, 386. For this reason, in the preferable form, the belt 392 has a plurality of longitudinal V ribs riding in complementary V groves in the pulleys to facilitate twisting. One such drive belt is manufactured by Goodyear under the trade name "poly-V Belt." It will be understood, however, that other types of belts such as an O-ring belt could be used without departing from the scope of the invention. The drive belt means includes a second drive belt 394, also shown as having V grooves, which extends over the speed reducer drive pulley 376 and the pulley 384 of the agitate speed reducer unit on stub shaft 380.

In its agitate mode of operation, represented by solid line arrows in FIGS. 6 and 9, when the motor shaft 372 and the driving pulley 376 are rotating in a counterclockwise direction the spin clutch pulley 370 will be free running on the motor shaft 372 in the same direction. The belt 394 drives the large agitate pulley 384 and stub shaft 380 in a counterclockwise direction and through the agitate clutch pulley 386, which is engaged, will drive the upper driven pulley 331 in a clockwise direction and the lower driven pulley 350 in a counterclockwise direction at a fixed single speed.

As seen in FIG. 6, sensing means in the form of an optical source and sensor or detector block 400 is positioned on the upper coil 338. In a manner similar to the sensing means of the FIGS. 1–5 embodiment an infrared light-emitting diode (LED) light source or lamp in the block 400 is directed on an encoder ring 402 on the clutch armature disc 334. The ring 402 has an alternate 180° dark portion 404 and a 180° light portion 406 in a manner shown, for example, in U.S. Pat. No. 3,323,051 to Woods and assigned to the same assignee as the present application. The large amount of infrared light that is reflected from the ring 402 during the time the light portion 406 is being rotated under a photo-transistor sensor in block 400 as compared to the small amount during the time the dark portion 404 is under the sensor is read by the photo-transistor in the block 400. A 110 VAC power supply 410 energizes the LED such that the reflected light is received by the photo-transistor causing its energization and the generation of a feedback voltage pulse which is amplified by an amplifier before being applied to a suitable control module. It will be noted in FIGS. 6 and 8 that the control module 418, which is shown physically located on the depending housing portion 310, is connected to the detector block 400 by electrical leads 419 positioned in groove 420. The control module 418 directs a suitable voltage pulse alternately to the upper clutch coil 338 and the lower clutch coil 339.

The armature discs 334 and 336, which are of flat washer-like configuration and made of magnetic material, are supported by resilient means in the form of the spring arms 356 secured to the agitate shaft 306 for reciprocative axial movement relative to the coils 338, 339. The spring wave washers 337 urge or bias the armature discs 334 and 336 apart and into light non-driving contact with friction pads 344 and 346 of pulleys 331 and 350 respectively, to reduce or eliminate impact noise.

Clockwise 180° rotation of the armature disc and agitator shaft is achieved upon energization of upper field winding 338 which produces axial movement of the armature in an upper direction against the force of spring arms 356 placing the upper clutch pad 344 into frictional engagement with the upper pulley face 344. Pulsing the lower clutch coil causes the armature disc 336 to frictionally engage the lower pulley face 348 and produce 180° counterclockwise rotation of the agitate shaft.

In applicant's embodiment of FIGS. 6–9 the speed and stroke of the agitator depend upon the relationship between the agitate speed reducer unit pulley 384 and drive pulley 376 arrangement together with the speed reduction between the clutch pulley 386 and driven pulleys 331 and 350. Where the motor 360 is a 4/6-pole reversible motor having full load speeds of about 1800 R.P.M. and 1200 R.P.M. respectively, when operated as a four pole motor the stub shaft 380 speed is reduced to about 650 R.P.M. so that an agitate shaft 306 rate of about 80 to 100 oscillations or strokes per minute is achieved. Thus, in counterdistinction to the applicant's washer drive mechanism of FIGS. 1–5, wherein the clutch 170 is slipped by varying the voltage applied to the solenoid coils 195 and 196 to achieve the desired agitator speed and stroke, the two belt single agitator speed and stroke arrangement of FIGS. 6–9 achieves a substantial savings in energy by means of the agitate speed reducer unit.

To achieve a spin cycle of the washer spin basket 28 the rotation of the motor 360 is reversed wherein the spin driving overrunning clutch 374 is rotated in a clockwise engaged manner to drive the spin pulley 370. At the same time the agitate speed reducer pulley 384 and stub shaft 380 are driven in a clockwise direction causing the agitate clutch pulley to overrun to allow the spin pulley 370 to rotate the driven pulleys at about 640 R.P.M. It will be noted by the dashed arrow in FIG. 9 that the drive belt 392 continues to drive in the same direction as it did during its agitator drive mode of operation.

Figure 7:
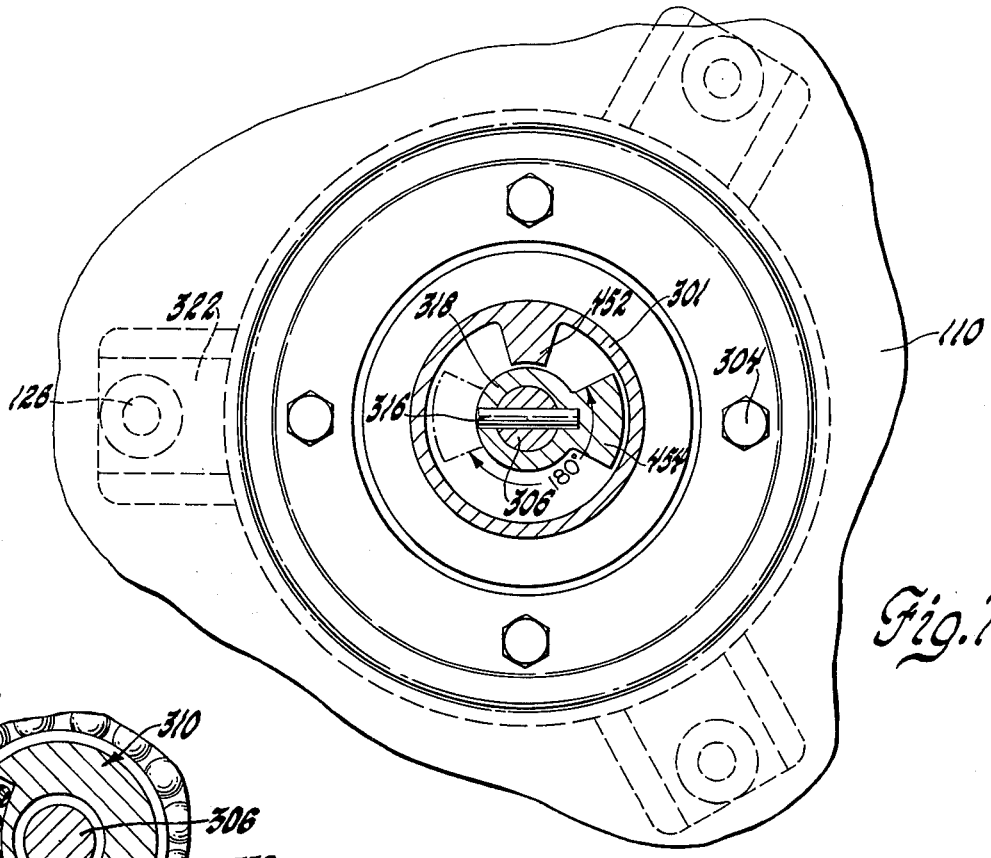
FIG. 7 is an enlarged fragmentary sectional view taken substantially on the line 7—7 of FIG. 6.
Figure 8:
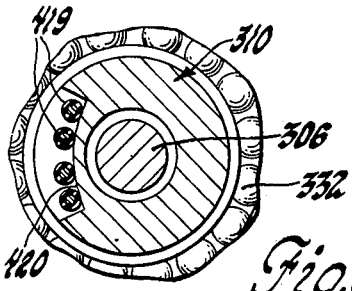
FIG. 8 is an enlarged fragmentary sectional view taken on the line 8—8 of FIG. 6.

As seen in FIGS. 6 and 7 of the alternate form of the invention coupling means, generally indicated at 450 in FIG. 6, are provided which function to connect the outer spin shaft assembly upwardly extending sleeve portion 301 and the inner concentric agitate shaft 306 during a spin drying operation. The coupling means 450 includes a radial driven lug member 452 shown integrally formed on the inner wall of spin shaft sleeve 301 and a driving lug 454 integral with the agitator driver 318. As in the first embodiment of the invention the agitate shaft drive lug 454 is free to oscillate with the agitate shaft through its agitation 180° arc without engaging the lug 452. The control module 418 is operative, upon the user setting the proper cycle selection switches, to cause the clutch coil 339 to move the armature disc 336 into fixed or continuous locked drive engagement with the lower driven pulley 350 to effect counterclockwise spin of the basket 28. As stated above this occurs because the coupling means 450 is operative whereby the driving lug 454 engages the spin shaft driven lug 452 thereby coupling the agitate shaft 306 to the spin shaft assembly 300 to effect rotation of the spin tub.

With reference to the block diagram of FIG. 10 and the function chart of FIG. 11 the electronic control circuit for the embodiment of FIGS. 1–5 will now be described. With the single speed reversible motor 52 energized to its motor speed of 1750 RPMs in a counterclockwise rotation the pulleys 152 and 154 are driven at a maximum speed of 650 RPMs with the washer in its "SPIN-HI" mode of operation wherein clutch A is energized by the maximum force being delivered to clutch input actuating rod 190. Thus, a lock-on condition is achieved with the function speed set at 650 RPMs. This means that the clutch plate force is set to deliver a maximum number of inch pounds of torque, for example about 20–22 inch pounds in the form shown, whereby severely unbalanced loads in the spin tub will cause some slippage of clutch A but the motor 52 will not bog down thus allowing the spin cycle to be completed.

The function of the electronic control system of FIG. 10 is to provide variable voltage to the clutch solenoid coils 195 and 196 whereby various spin speeds and agitate speeds are attained by controlling the slip speed of the clutches A and B. Thus, for example, a low or gentle spin speed "SPIN-LO" of about 430 RPMs may be selected by the cycle selector switch control 420 having manual two position switches 422 thereon. The selector switch 420 works in conjunction with sequence timer 424, with selector knob 425, and electronic control module assembly 418 to vary a preset resistance which reduces the voltage supplied to spin solenoid 196 of clutch A.

It will be noted in FIGS. 10 that the control module assembly 418, which includes an amplifier 428 and a control module 430, is provided with manual selector knobs 432 and 434 which allows for various resistances to be selected to control the amount of voltage applied to the solenoid coils 195 and 196. Thus, by reducing the inch pound of torque applied by rod 190 can be varied to control the amount of slippage between the clutches A and B and their respective driven pulleys 152 and 154. With reference to the chart of FIG. 11 it will be seen that an "Agitate-Lo" or ¢Agitate-Hi" speed or oscillations per minute can be achieved through the control module knob 432 to provide an "Agitate-Hi" function speed of 80 S/M or an "Agitate Lo" speed of about 55 S/M by means of the feedback signal from the detector 235. The control knob 434 of module 430 is provided to allow the sensor 235 to detect the angular position of the disc 230 by "reading" the spaces between the segments 234 to also control the stroke angle of the agitator.

While the embodiment of the present invention as herein disclosed constitutes a preferred form it is to be understood that other forms might be adopted.

I claim:

1. In a washing machine, a tub, an agitator in said tub, means for rotatably supporting said tub, a double-ended reversible power drive shaft, and power transmitting means drivingly connecting said drive shaft to said tub for rotating said tub and to said agitator for oscillating said agitator, said power transmitting means comprising first and second concentrically arranged driven pulleys rotatably carried in fixed respective planes with respect to said agitator and said tub, drive belt means encircling said driven pulleys and opposite ends of said drive shaft, clutch means for drivingly rotating said agitator relative to either of said driven pulleys, said clutch means being selectively operable to effect a driving relationship first between said drive shaft and one of said driven pulleys and then between said drive shaft and the other of said driven pulleys when said drive shaft is operating through said belt means to rotate said driven pulleys in opposite directions, and means for actuating said clutch means in a continuously repetitive pulsating manner to effect the back and forth oscillation of said agitator in said tub.

2. In a washing machine, a tub, an agitator in said tub, means for rotatably supporting said tub, spin shaft means for rotating said tub, agitate shaft means concentrically encircled by a portion of said spin shaft means, a double-ended reversible power drive shaft, and power transmitting means drivingly connecting said drive shaft to said tub spin shaft means for rotating said tub and to said agitator shaft means for oscillating said agitator, said power transmitting means comprising first and second concentrically arranged driven pulleys rotatably carried in fixed respective planes with respect to said agitator shaft means and said tub shaft means, a single drive belt encircling said driven pulleys and opposite ends of said drive shaft, whereby said driven pulleys will be simultaneously driven in opposite directions of rotation by rotation of said drive shaft in either direction, clutch means between said driven pulleys for drivingly rotating said agitate shaft means relative to either of said driven pulleys, coupling means operative to couple said agitate shaft means to said spin shaft means upon said agitate shaft being rotated through a predetermined arc, said coupling means being inoperative when said agitate shaft means is oscillated through a predetermined stroke less than said arc, said clutch means being selectively operable to effect a driving relationship first between said drive shaft and one of said driven pulleys and then between said drive shaft and the other of said driven pulleys when said shaft is operating through said belt means to rotate said driven pulleys in opposite directions, means for actuating said clutch means in a continuously repetitive pulsating manner to effect the back and forth oscillation of said agitator in said tub, and said actuating means being controllable in another manner for moving said clutch means into continuous engagement with one of said driven pulleys to effect rotation of said tub through said spin shaft means and said coupling means by rotating said agitator shaft means.

3. An ocillate and spin drive mechanism for use with nested outer and inner tubs of a domestic clothes washer in which the outer tub is adapted to contain washing fluid and the inner tub contains an oscillatable agitator and is adapted to be rotatable within said outer tub, and in which both tubs have central openings in the bottoms thereof, said mechanism comprising, agitator shaft means having an upper portion extending through the openings in both said tubs and adapted for drivingly connecting with said agitator to oscillate said agitator in a fixed plane when said agitator shaft means is ocillating, spin shaft means extending through the opening in said outer tube and adapted for drivingly connecting with said inner tub, coupling means for selectively drivingly interconnecting said spin shaft means with said agitator shaft means for rotation therewith to rotate said inner tub when said agitator shaft means is rotating, support means encircling portions of said agitator shaft means and said spin shaft means and adapted for attachment with respect to the opening in said outer tub for supporting said mechanism in said clothes washer, upper and lower concentrically arranged driven pulleys relatively rotatably carried in fixed respective planes with respect to said agitate shaft means and said spin shaft means, clutch means between said driven pulleys and relatively rotatably limited with respect to said agitator shaft means but axially movable with respect to said driven pulleys for selective engagement with said driven pulleys, actuating means selectively operable to move said clutch means into engagement alternately with said upper and lower driven pulleys, a double-ended, reversible power drive shaft for driving said driven pulleys, said drive shaft having a drive pulley on one end thereof, an idler pulley rotatably interrelated with the other end of said drive shaft and operatively mounted in spaced relation with said drive pulley, a single drive belt operatively mounted in a single pass on said drive pulley, said upper driven pulley in the fixed plane thereof, said idler pulley and said lower driven pulley in the fixed plane thereof, whereby said driven pulleys will be simultaneously driven in opposite directions of rotation by rotation of said drive shaft in either direction, said actuating means being controllable in one manner for moving said clutch means into alternate engagement with said upper and lower driven pulleys in a continuous, repetitive manner to effect oscillatory movement of said agitator by oscillating said agitator shaft means, and said actuating means being controllable in another manner for moving said clutch means into continuous engagement with one of said upper and lower driven pulleys to effect rotation of said spin tub through said spin shaft means and said coupling means by rotating said agitator shaft means.

4. In a washing machine, a tub, an agitator in said tub, means for rotatably supporting said tub, spin shaft means for rotating said tub, agitate shaft means concentrically encircled by a portion of said spin shaft means, a double-ended reversible power drive shaft and stub shaft means located in parallel offset relation with said motor drive shaft, and power transmitting means drivingly connecting said drive shaft to said tub spin shaft means for rotating said tub and to said agitator shaft means for oscillating said agitator, said power transmitting means comprising first upper and second lower concentrically arranged driven pulleys rotatably carried in fixed respective planes with respect to said agitator shaft means and said tub shaft means, said drive shaft having a one-way spin drive pulley clutch on one end and a speed reducer drive pulley in axially spaced relation therefrom, said stub shaft means having a driven agitate speed reducer pulley and a one-way pulley clutch mounted in spaced relation thereon, a single drive belt encircling said spin drive pulley, said upper driven pulley, said agitate speed reducer pulley and said lower pulley, speed reducer belt means encircling said speed reducer drive and driven pulleys, whereby said driven pulleys will be simultaneously driven in opposite directions of rotation and said one-way agitate clutch by rotation of said drive shaft in a first agitate direction and said one-way agitate clutch rotated in its driving direction, clutch means between said driven pulleys for drivingly rotating said agitate shaft means relative to either of said driven pulleys, coupling means operative to couple said agitate shaft means to said spin shaft means upon said agitate shaft being rotated through a predetermined arc, said coupling means being inoperative when said agitate shaft means is oscillated through a predetermined stroke less than said arc, said clutch means being selectively operable to effect a driving relationship first between said drive shaft and one of said driven pulleys and then between said drive shaft and the other of said driven pulleys when said drive shaft is rotating in its agitate directing through said single belt means and said speed reducer belt means to rotate said driven pulleys in opposite directions, means for actuating said clutch means in a continuously repetitive manner to effect the back and forth oscillation of said agitator in said tub, and said actuating means being controllable in another manner for moving said clutch means into continuous engagement with one of said upper and lower driven pulleys to effect rotation of said tub through said spin shaft means and said coupling means by rotating said drive shaft in a second spin direction, whereby said one-way spin clutch is rotated in its driving direction and said stub shaft one-way pulley clutch is rotated in its overrunning direction.

5. In a domestic clothes washer, an outer tub having a bottom bulkhead adapted to contain washing fluid and having an outer tub opening, an inner tub nested within said outer tub in spaced relation thereto and adapted for rotation within said outer tub, said inner tub having a central inner tub opening in the bottom thereof, an agitator adapted for movement within said inner tub, spin shaft means concentric with said outer tub opening for rotating said inner tub, agitator shaft means having an upper portion concentrically arranged within said spin shaft means for moving said agitator, an agitate and spin drive mechanism for operating said inner tub and agitator comprising, a reversible drive motor with a drive shaft for driving said mechanism, said motor drive shaft having a one-way overruning clutch including a spin drive pulley and a speed reducer drive pulley in spaced relation on said drive shaft, upper and lower concentrically arranged vertically spaced driven pulleys, means for supporting said driven pulleys in a freely rotatable concentric manner with said agitator shaft means, electrical clutch means fixed on said agitate shaft, actuating means operative to move said electric clutch means for engagement alternately with said upper and lower driven pulleys, an agitate speed reducer unit mounted intermediate said drive motor and said spin shaft, said unit having stub shaft means located in parallel offset relation with said motor drive shaft, said stub shaft means having a driven agitate speed reducer pulley and a one-way overrunning agitate clutch including a pulley mounted thereon, single drive belt means operatively mounted on said spin drive pulley, said upper driven pulley, said agitate speed reducer pulley and said lower driven pulley; speed reducer belt means operatively mounted on said speed reducer drive and driven pulleys, wherein said driven pulleys will be simultaneously driven in opposite directions of rotation and said overrunning agitate clutch rotated in its driving direction by said drive motor being driven in a first agitate direction, and clutch actuating means operative by electrical control means for moving said electrical clutch means into alternate engagement with said upper or lower driven pulleys to effect oscillatory movement of said agitator, coupling means operative upon engagment to connect said agitate shaft means to said spin shaft means, and said electrical control means operative to drive said motor in its second opposite direction causing said overrunning spin clutch to be rotated in its driving direction, said control means also operative to selectively engage said electrical clutch means in driving relation with said lower driven pulley positions thereby effecting engagement of said coupling means to drive said spin shaft means for rotation of said spin tub.

* * * * *